US007757612B2

(12) United States Patent
Korber et al.

(10) Patent No.: US 7,757,612 B2
(45) Date of Patent: Jul. 20, 2010

(54) CONVERTIBLE WORKSTATION

(76) Inventors: Jeffrey H. Korber, CBT Supply, Inc., P.O. Box 391, Hibernia, NJ (US) 07842; Michael G. Wisniewski, CBT Supply, Inc., P.O. Box 391, Hibernia, NJ (US) 07842

( * ) Notice: Subject to any disclaimer, the term of this patent is extended or adjusted under 35 U.S.C. 154(b) by 380 days.

(21) Appl. No.: 11/903,987

(22) Filed: Sep. 25, 2007

(65) Prior Publication Data

US 2008/0072803 A1 Mar. 27, 2008

Related U.S. Application Data

(60) Provisional application No. 60/846,917, filed on Sep. 25, 2006.

(51) Int. Cl.
*A47B 81/00* (2006.01)

(52) U.S. Cl. ..... 108/25; 108/50.02; 312/223.3

(58) Field of Classification Search ..... 108/25, 108/26, 50.01, 50.02; 312/196, 233.3, 208.1, 312/24–30

See application file for complete search history.

(56) References Cited

U.S. PATENT DOCUMENTS

| | | | | | |
|---|---|---|---|---|---|
| 993,588 | A | * | 5/1911 | Donning | 312/26 |
| 1,207,400 | A | * | 12/1916 | Harris | 312/26 |
| 1,565,247 | A | * | 12/1925 | Axen | 312/23 |
| 2,125,777 | A | * | 8/1938 | Estrates et al. | 312/23 |
| 2,589,393 | A | * | 3/1952 | James | 312/30 |
| 3,393,029 | A | * | 7/1968 | Ellis | 312/25 |
| 4,488,497 | A | * | 12/1984 | Bevans | 108/147.21 |
| 4,590,866 | A | | 5/1986 | Schairbaum | |
| 4,735,467 | A | | 4/1988 | Wolters | |
| 4,766,422 | A | | 8/1988 | Wolters | |
| 5,125,727 | A | | 6/1992 | Lechman | |
| D329,551 | S | | 9/1992 | Lechman | |
| D335,047 | S | | 4/1993 | Lechman | |
| 5,199,773 | A | | 4/1993 | Price, Jr. et al. | |
| D335,782 | S | | 5/1993 | Lechman | |
| RE34,266 | E | | 6/1993 | Schairbaum | |
| D342,396 | S | | 12/1993 | Lechman | |
| 5,294,193 | A | | 3/1994 | Wegman | |
| 5,410,972 | A | | 5/1995 | Schairbaum | |
| D364,049 | S | | 11/1995 | Lechman | |
| 5,526,756 | A | | 6/1996 | Watson | |
| D372,601 | S | | 8/1996 | Roberts | |
| 5,572,935 | A | | 11/1996 | Schairbaum | |
| 5,611,608 | A | | 3/1997 | Clausen | |
| 5,622,395 | A | | 4/1997 | Shine | |
| 5,626,323 | A | | 5/1997 | Lechman | |
| 5,651,594 | A | | 7/1997 | Lechman | |
| 5,655,823 | A | | 8/1997 | Schairbaum | |
| 5,685,236 | A | | 11/1997 | Lechman | |
| 5,699,225 | A | | 12/1997 | Yavitz | |

(Continued)

*Primary Examiner*—Janet M Wilkens

(57) ABSTRACT

A convertible workstation is convertible from a generally flat, planar work surface to a computer workstation. A support panel is pivotably mounted within the work surface and holds a support tray configured for holding a portable computer, such as a laptop computer. When closed, the convertible workstation provides a secure environment for storing a computer and a traditional work surface. When opened, the convertible workstation provides an ergonomically configured computer workstation. The convertible workstation may provide computer connections, for instance power, data, and/or other computer connections, both when the workstation is configured as a computer workstation and when configured as a work surface (thus storing the computer within the workstation).

23 Claims, 15 Drawing Sheets

U.S. PATENT DOCUMENTS

| | | | | |
|---|---|---|---|---|
| 5,699,744 | A | 12/1997 | Lechman | |
| 5,740,743 | A | 4/1998 | Schairbaum | |
| 5,957,059 | A | 9/1999 | Burhman | |
| 5,964,164 | A | 10/1999 | Lechman | |
| 6,019,051 | A | 2/2000 | Schairbaum | |
| 6,085,431 | A | 7/2000 | Schairbaum | |
| 6,092,883 | A | 7/2000 | Lechman | |
| D429,088 | S | 8/2000 | Lechman | |
| D429,579 | S | 8/2000 | Lechman | |
| 6,128,186 | A | 10/2000 | Feierbach | |
| 6,135,298 | A | 10/2000 | Lechman | |
| 6,152,046 | A | 11/2000 | Schairbaum | |
| 6,168,250 | B1 | 1/2001 | Rogov | |
| D437,506 | S | 2/2001 | Lechman | |
| D438,401 | S | 3/2001 | Lechman | |
| D440,069 | S | 4/2001 | Lechman | |
| 6,237,507 | B1 | 5/2001 | Yanagisawa et al. | |
| 6,286,440 | B1 | 9/2001 | Jyrungi | |
| 6,419,330 | B1 | 7/2002 | Lechman | |
| 6,431,377 | B1 | 8/2002 | Lechman | |
| 6,463,862 | B1 | 10/2002 | Kuhlman et al. | |
| 6,474,760 | B2 | 11/2002 | Rauls | |
| 6,553,919 | B1 | 4/2003 | Nevin | |
| 6,601,931 | B1 | 8/2003 | Schairbaum | |
| 6,609,465 | B2 | 8/2003 | Kolavo | |
| 6,802,577 | B2 * | 10/2004 | Gershfeld | 312/223.3 |
| 7,047,890 | B2 | 5/2006 | Korber et al. | |
| 7,100,516 | B2 * | 9/2006 | Riddiford et al. | 108/50.01 |
| 7,509,912 | B2 * | 3/2009 | Stengel et al. | 108/50.01 |
| 7,578,243 | B2 * | 8/2009 | Gevaert | 108/25 |
| 2003/0070592 | A1 * | 4/2003 | Grasse et al. | 108/50.02 |
| 2003/0230222 | A1 * | 12/2003 | Liu | 108/50.01 |
| 2004/0070319 | A1 * | 4/2004 | Miller | 312/208.1 |
| 2005/0145142 | A1 | 7/2005 | Korber et al. | |
| 2006/0185564 | A1 | 8/2006 | Stengel et al. | |
| 2006/0191445 | A1 | 8/2006 | Stengel et al. | |
| 2008/0072801 | A1 * | 3/2008 | Korber et al. | 108/7 |
| 2008/0178778 | A1 * | 7/2008 | Koning et al. | 108/132 |
| 2008/0278046 | A1 * | 11/2008 | Scheffy et al. | 312/223.6 |

* cited by examiner

CONVERTIBLE WORKSTATION

CROSS REFERENCE TO RELATED APPLICATION

This application is based upon and claims benefit of copending U.S. Provisional Patent Application Ser. No. 60/846,917 entitled "Computer Workstation", filed with the U.S. Patent and Trademark Office on Sep. 25, 2006 by the inventors herein, the specification of which is incorporated herein by reference.

FIELD OF THE INVENTION

The present invention relates to computer workstations and, more particularly, to a computer workstation convertible from a flat work surface and computer storage device to a computer workstation.

DESCRIPTION OF THE BACKGROUND

Computers have become an integral tool of society, and their use continues to increase. Whether at the workplace or at remote locations ranging from conference centers to coffee shops, computers have become a necessary tool. Moreover, the portability of laptop computers has made their use even more pervasive, given the added mobility they offer over traditional "desktop" computers. The ease with which a laptop computer may be transported and prepared for use in any environment has users setting up impromptu computing centers at any location. However, often times limited space is available to serve as a base for such an impromptu computing center. For instance, in a conference center, it is often preferred to provide a table or desk to provide attendees a work surface on which they can take notes, spread out papers, etc., leaving little room (much less connectivity) for a laptop computer.

A wide variety of desks have been designed to accommodate desktop computers, often including large storage compartments for the central processing unit, pull-out keyboard trays, openings in the desk surface to receive wires running to monitors, mouses, keyboards, and the like, and large monitors provided on the top of the desk surface, thus using valuable space that could otherwise be used as a work surface. Portable computers, such as laptop computers, in one aspect provide an advantage over desktop computers in that they simply take up less space than is required for a desktop computer and all of its required peripheral devices. However, the portability of the laptop computer, while minimizing the space necessary to establish a computing environment, also makes the laptop a ready target for theft. For instance, if at a conference center, a user may wish to leave their laptop setup at their seat location during a break, leaving the laptop unattended on the work surface, thus enticing unscrupulous passers-by to walk off with the user's computer.

Further, in such a remote environment, a computer user will often desire computer connectivity, at a minimum to power and preferably to data connections and/or connections to other peripheral computer equipment. Of course, traditional work surfaces typically provided in these environments lack such connectivity features.

Thus, there remains an unmet need to provide a work surface, such as a conference table, that in can be used as a traditional work surface, but that can also serve as a workstation, for example a computer workstation, that provides sufficient security to prevent unauthorized access to the computer and that provides computer connectivity to, for instance, power, data, and other computer connections.

SUMMARY OF THE INVENTION

The present invention provides a convertible workstation converting from a generally flat, planar work surface to a computer workstation. With regard to one aspect of a particularly preferred embodiment, the convertible workstation provides a secure environment for storing a computer, such as a portable or laptop computer, when configured as a work surface, and an ergonomically configured computer workstation when opened from such storage configuration. With regard to another aspect of a particularly preferred embodiment, the convertible workstation provides computer connections, for instance a power, data, and/or other computer connection, both when the workstation is configured as a computer workstation and when configured as a work surface (thus storing the computer within the workstation).

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF CERTAIN EMBODIMENTS OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
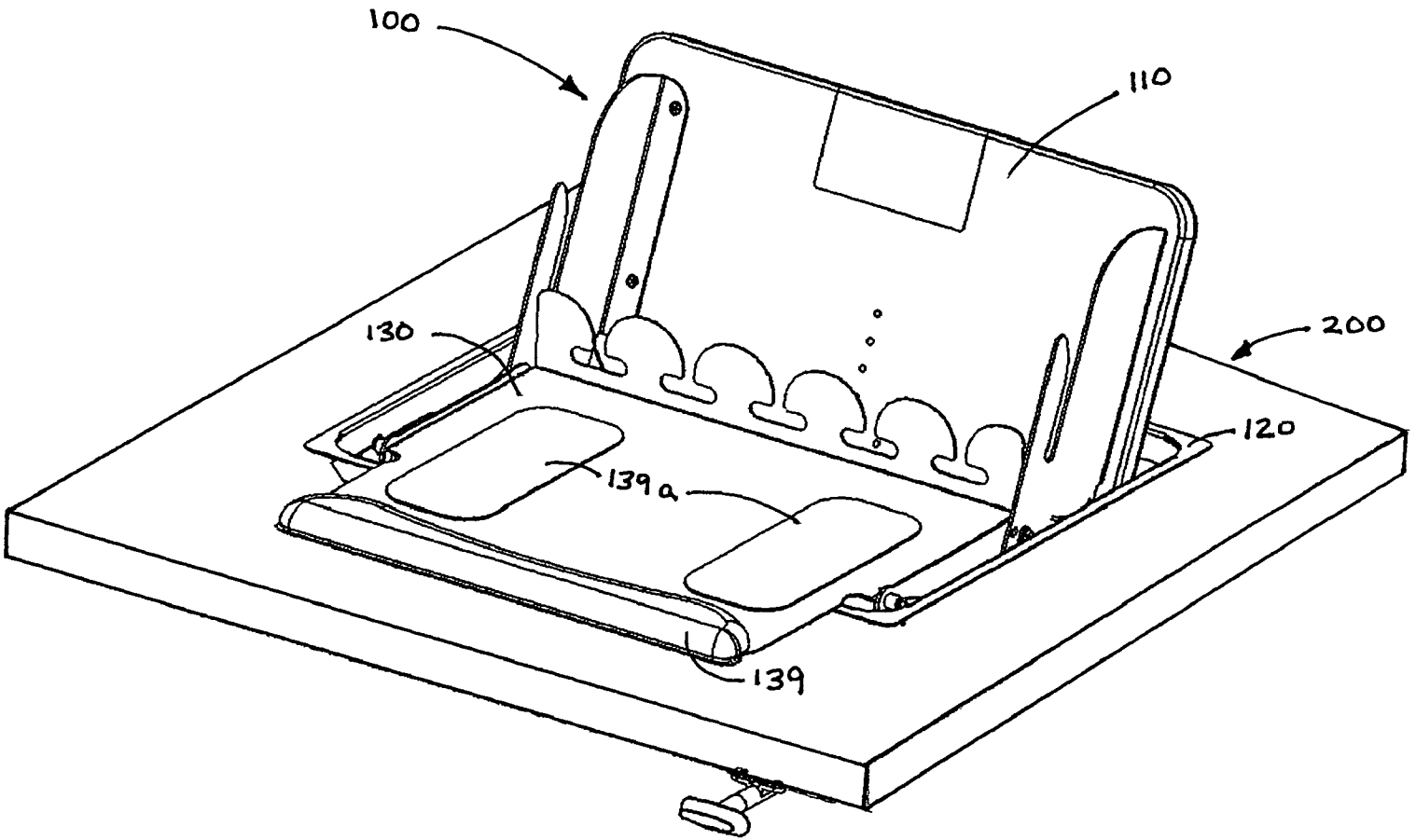
FIG. 1 is a perspective view of a convertible workstation according to an embodiment of the invention in an open position.
Figure 2:
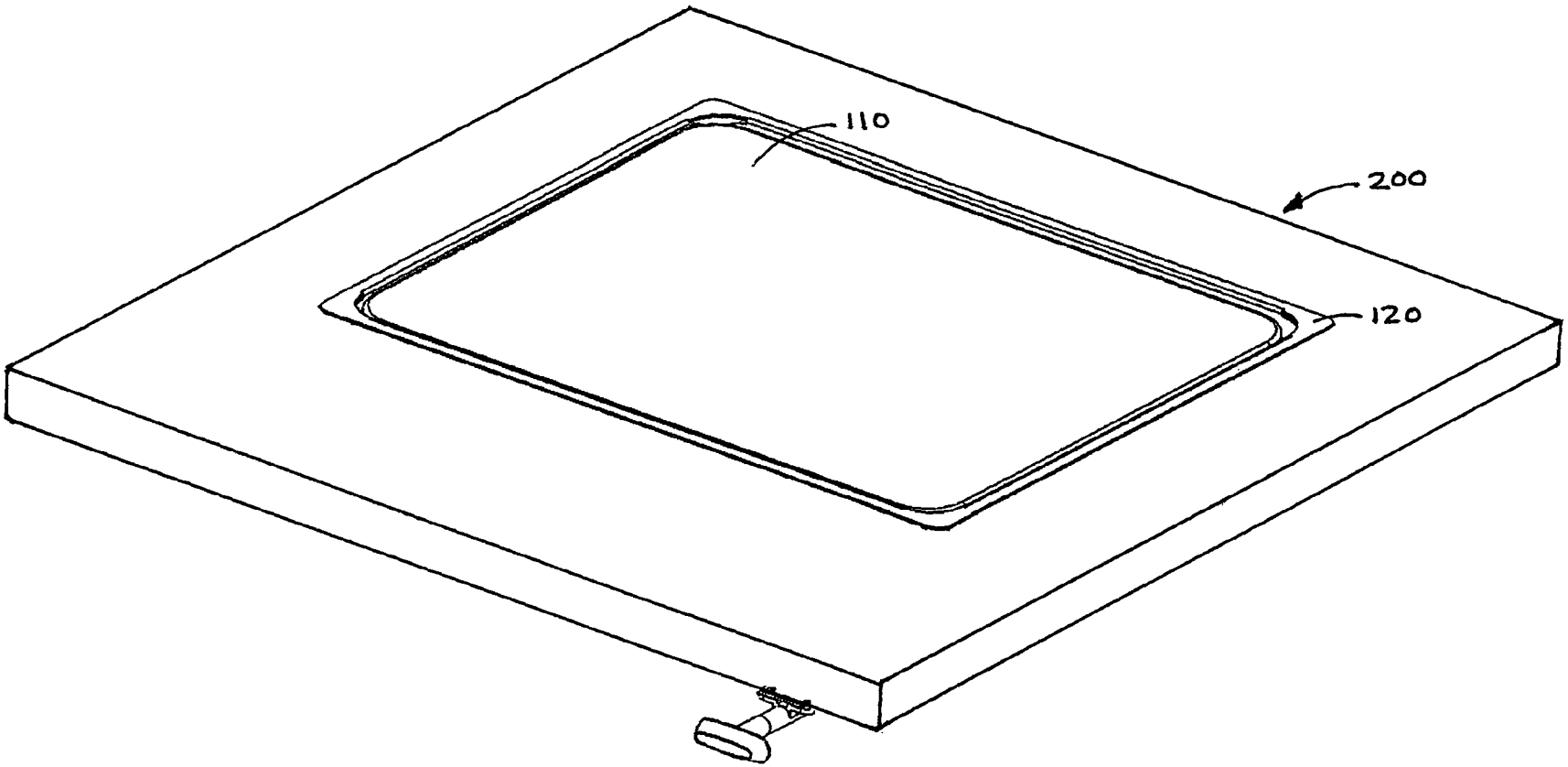
FIG. 2 is a perspective view of the convertible workstation if FIG. 1 in a closed position.

FIG. 1 shows an embodiment of a convertible workstation (shown generally at 100) positioned within a work surface (shown generally at 200). Work surface 200 may be the top of a desk, a table, a podium, or any other surface suitable for use as a flat work surface. A support panel 110, the bottom side of which is visible in FIG. 1, is pivotably mounted within an opening formed in work surface 200. Preferably, a frame 120 is situated within such opening and fixed with respect to work surface 200, and support panel 110 is pivotably mounted within frame 120. A support tray 130 is pivotably mounted to the bottom side of support panel 110. FIG. 1 provides a view of support panel 100 in an open position, in which support tray 130 is situated in a deployed position. In such deployed position, a laptop or other portable computing device situated on support tray 130 may be opened and positioned in a comfortable position for use by a person sitting in front of workstation 100, thus providing a computer station for such person. As shown in FIG. 1, when in such deployed position, a front section of support tray 130 is supported from below by the flat work surface 200. FIG. 2 shows support panel 110 in a closed position in which the top side of support panel 110 is generally coplanar with work surface 200, and support tray 130 is situated in an inaccessible and stored position below and on an underside of work surface 200.

Figure 3:
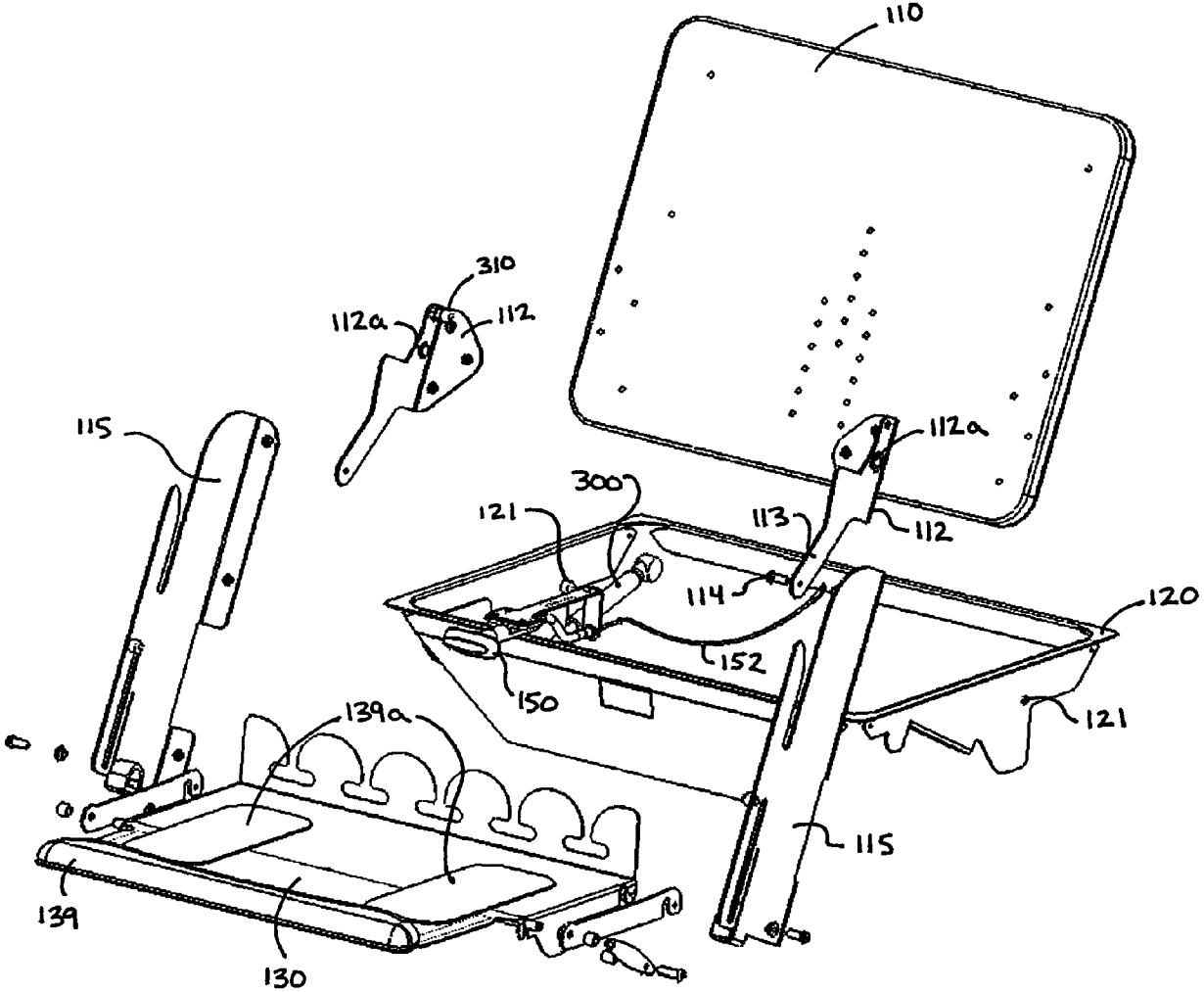
FIG. 3 is an exploded view of various components of the convertible workstation of FIG. 1.

FIG. 3 provides an exploded view of the convertible workstation of FIG. 1, and the separate elements of FIG. 3 are shown in and described below with reference to FIGS. 4-12.

Figure 4:
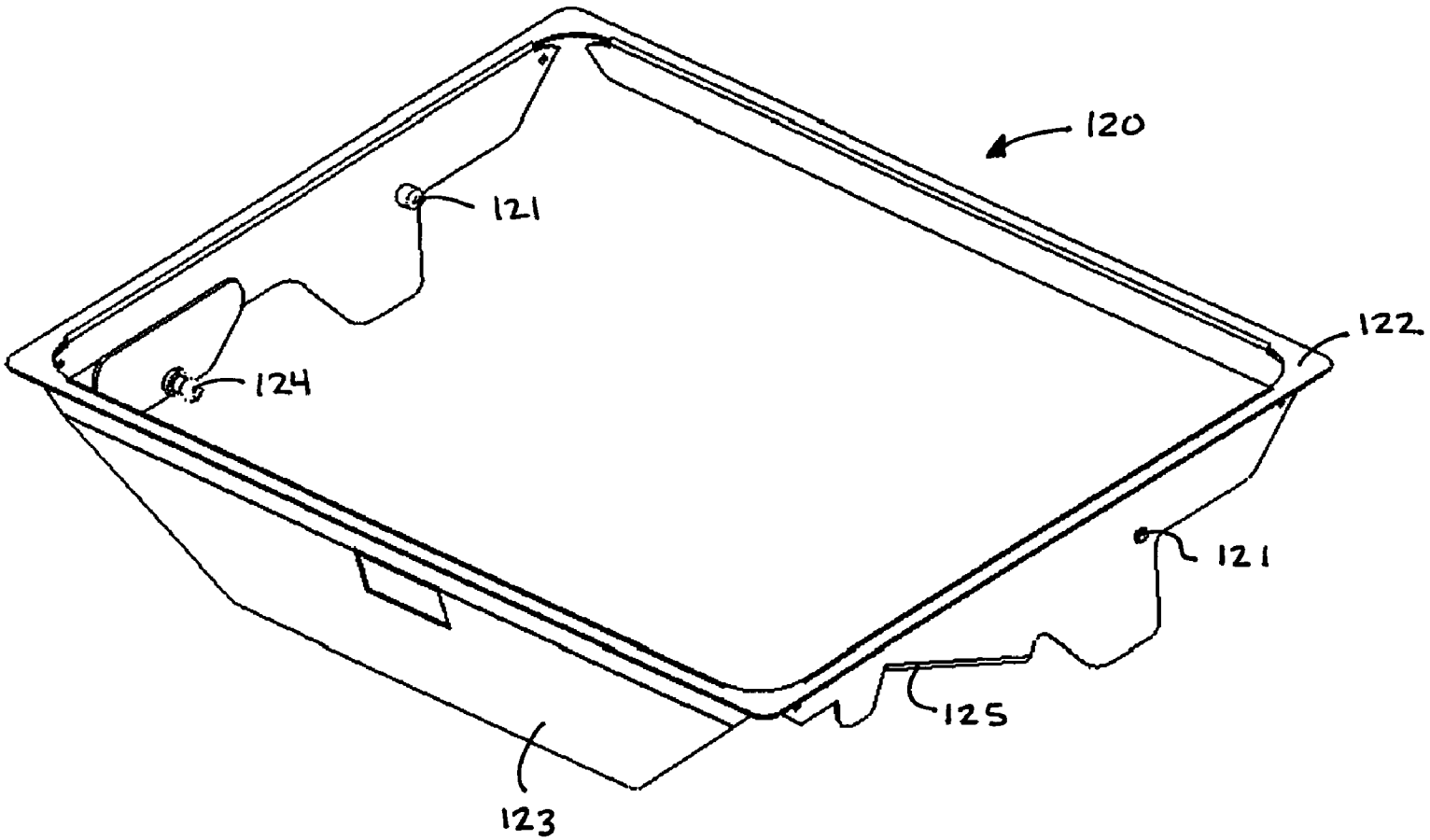
FIG. 4 is a perspective view of a frame for use in the convertible workstation of FIG. 1.
Figure 5:
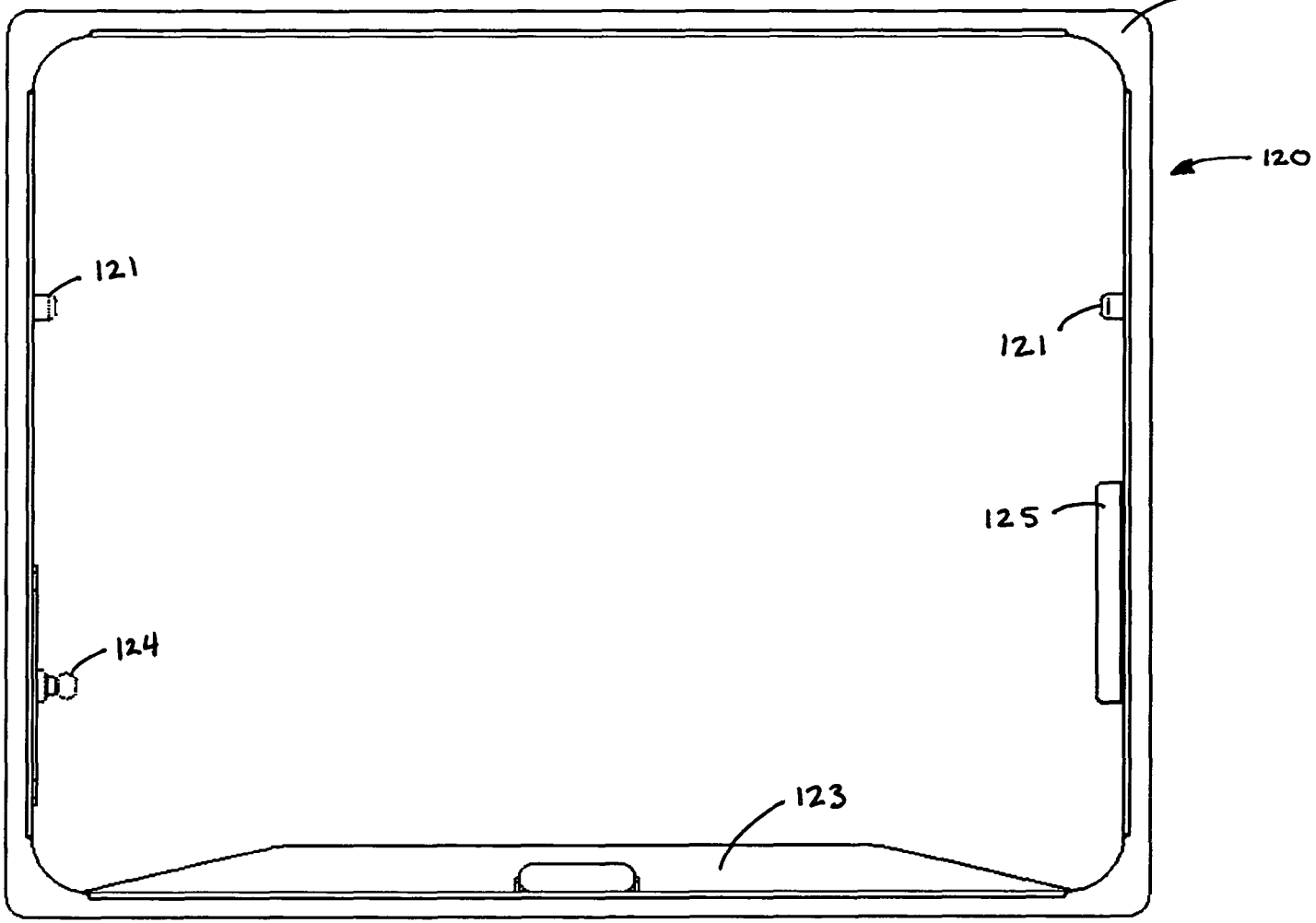
FIG. 5 is a top view of the frame of FIG. 4.

As shown in this embodiment and with reference to FIGS. 3-5, frame 120 is provided pivots 121 for pivotably mounting support panel 110. Frame 120 may include a generally horizontal top lip 122 which engages the top surface of work surface 200; alternately, top lip 122 may be eliminated such that the entirety of frame 120 sits within the opening in work surface 200, and in which case frame 120 is fastened to such opening by way of fasteners (e.g., screws, nails, etc.), adhesives, or the like, or may even be integrally formed (e.g., molded) with work surface 120. A flange 123 is preferably provided at the front of frame 120 and extends down from a top edge of work surface 120. Flange 123 is positioned such-that when the support panel is in its closed position, the top edge of the support panel is positioned adjacent to flange 123. Thus, flange 123 prevents access to support panel 110 (and to support tray 130 and its contents situated below support panel 110) when the support panel is in the closed position. As will be discussed in greater detail below, a spring connector 124 may be provided on an interior face of frame 120. Likewise, a stop ledge 125 may be provided on an interior face of frame 120, providing a guide and limiting surface to a roller on support tray 130 during opening of convertible workstation 100, as discussed in greater detail below.

Figure 6:
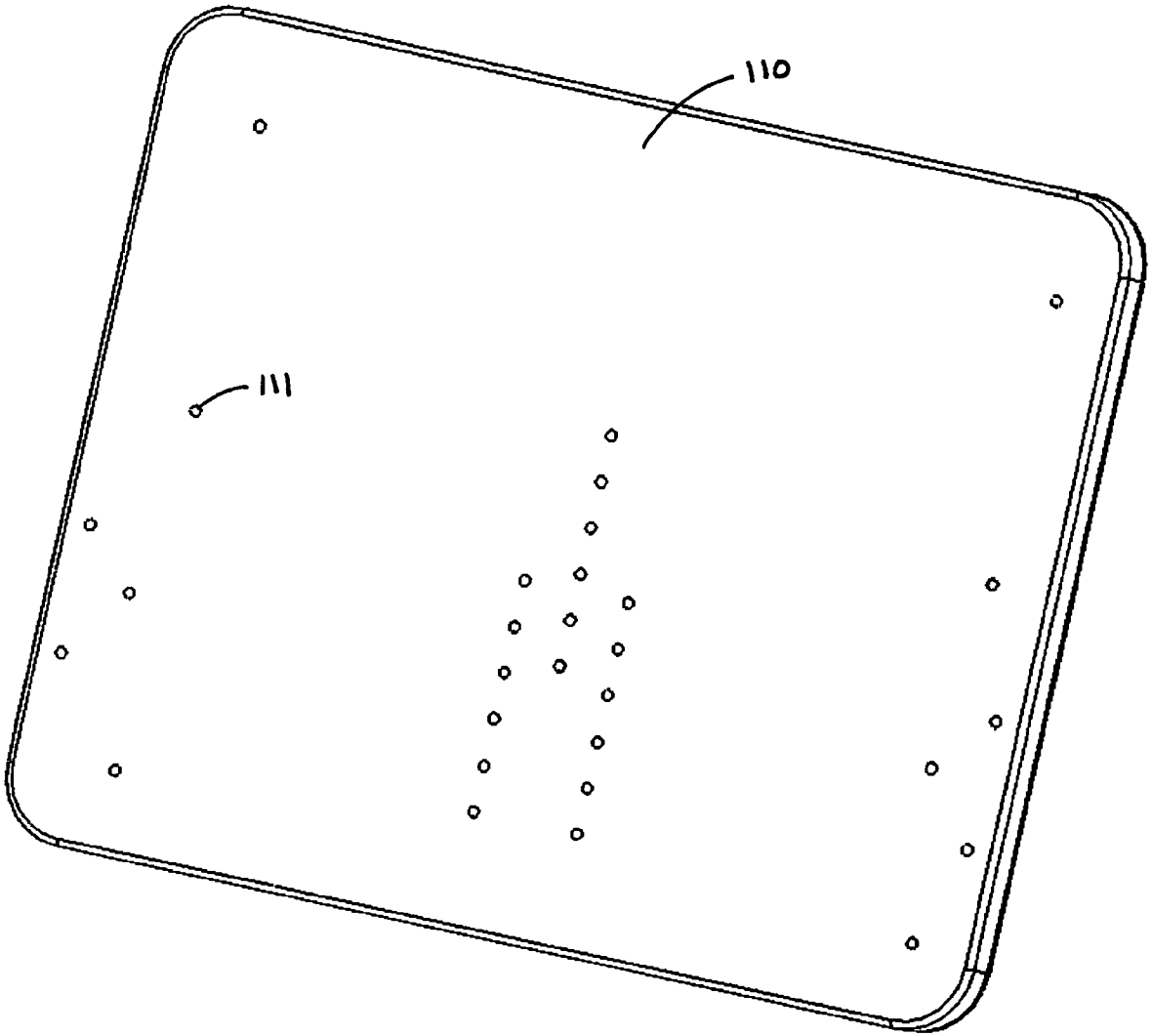
FIG. 6 is a perspective view of a support panel for use in the convertible workstation of FIG. 1.
Figure 7:
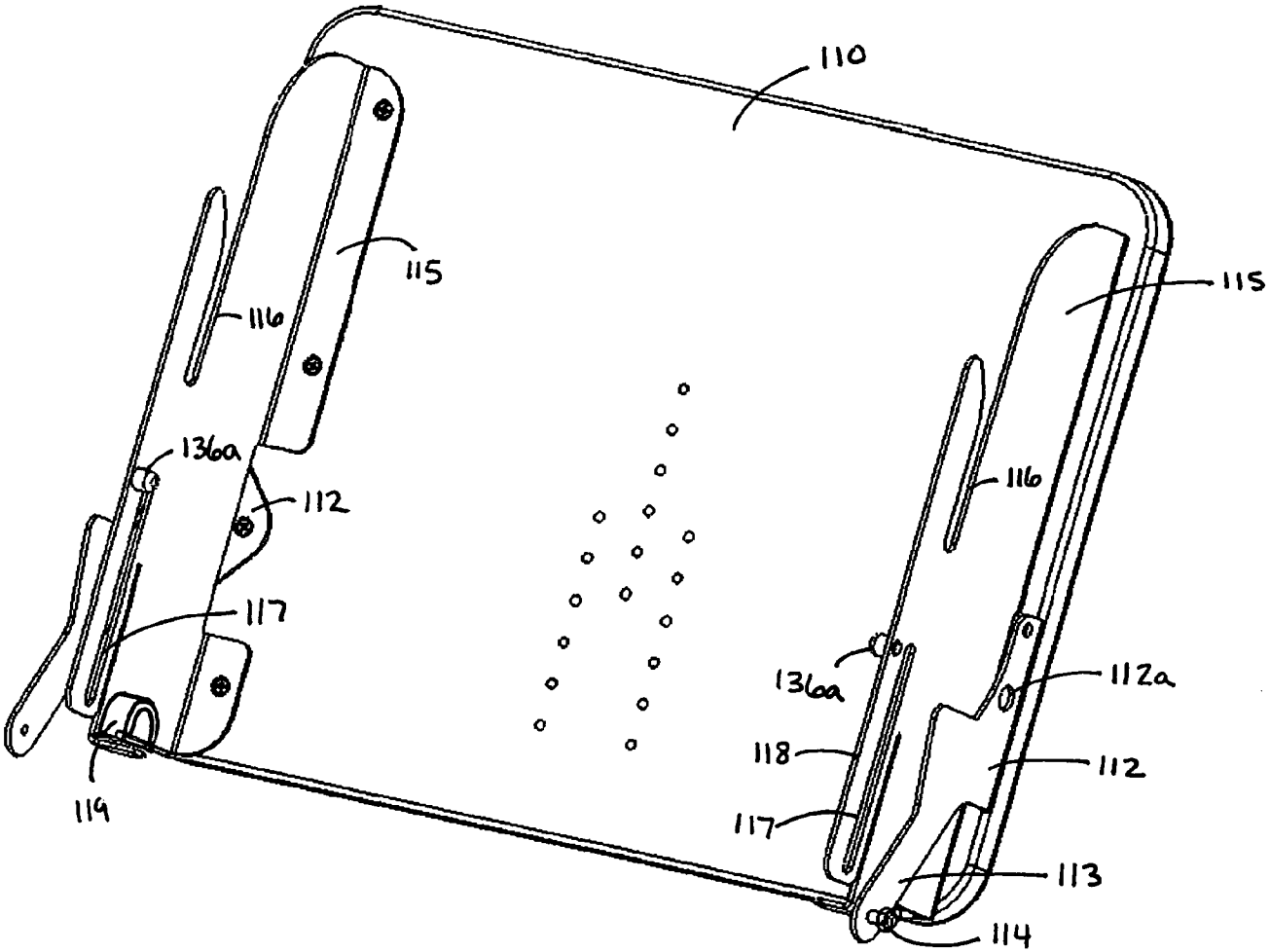
FIG. 7 is a perspective view of the support panel of FIG. 6 with additional support structures.

As shown in FIGS. 3 and 6-7, support panel 110 is a generally rectangular panel having a bottom side (visible in FIGS. 3 and 6-7) and a top side that preferably has a surface matching that of the top of work surface 200. Support panel 110 is also preferably provided a series of threaded openings 111 allowing connection of guide brackets 115 and pivot supports 112. Alternately, guide brackets 115 and/or pivot supports 112 may be formed integrally with support panel 110. Pivot supports 112 provide a pivot coupling 112*a* configured to engage pivots 121 on frame 120, thus pivotably mounting support panel 110 with respect to frame 120 (and thus with respect to work surface 200). At least one of pivot supports 112 also provides an extending arm 113 having a pin connection 114 receiving an end of a pull cable, as discussed in greater detail below. Likewise, at least one of pivot supports 112 provides a spring connector 310, such that a spring member (such as a gas spring 300) may be connected between spring connector 310 affixed to support panel 110 (through pivot support 112) and spring connector 124 on frame 120, preferably biasing support panel 110 toward an open position.

Brackets 115 preferably provide a roller guide channel 116 that engages rollers 131 on support tray 130, as discussed in greater detail below. Guide channels 116 are configured to allow movement of support tray 130 in a direction parallel to the bottom side of support panel 110. However, the open end of guide channels 116 allows rollers 131 of support tray 130 to escape the guide channels 116, such that after the rollers 131 exit guide channels 116, movement of support tray 130 is no longer limited to movement parallel to the bottom side of support panel 110. Brackets 115 also provide pivot slides 117 configured as open channels along brackets 1 15. Pivot slides 117 are configured to receive pivot pins 135 on support tray 130, allowing both lateral movement along slides 117 and pivoting movement between support tray 130 and brackets 115 (once rollers 131 of support tray 130 have escaped guide channels 116). Preferably, at least a portion of pivot slides 117 may be situated in a finger 118 of bracket 115, allowing finger 118 to be bent in slightly, in turn creating friction against support tray 130 so as to slow movement of support tray back towards a closed position, thus helping to avoid inadvertent slamming of support tray 130 into its closed position. Likewise, cushions 119 may be provided at the base of each bracket 115, each cushion provided a compressible stop against the back end of support tray 130 as support panel 120 moves toward its closed position.

Figure 8:
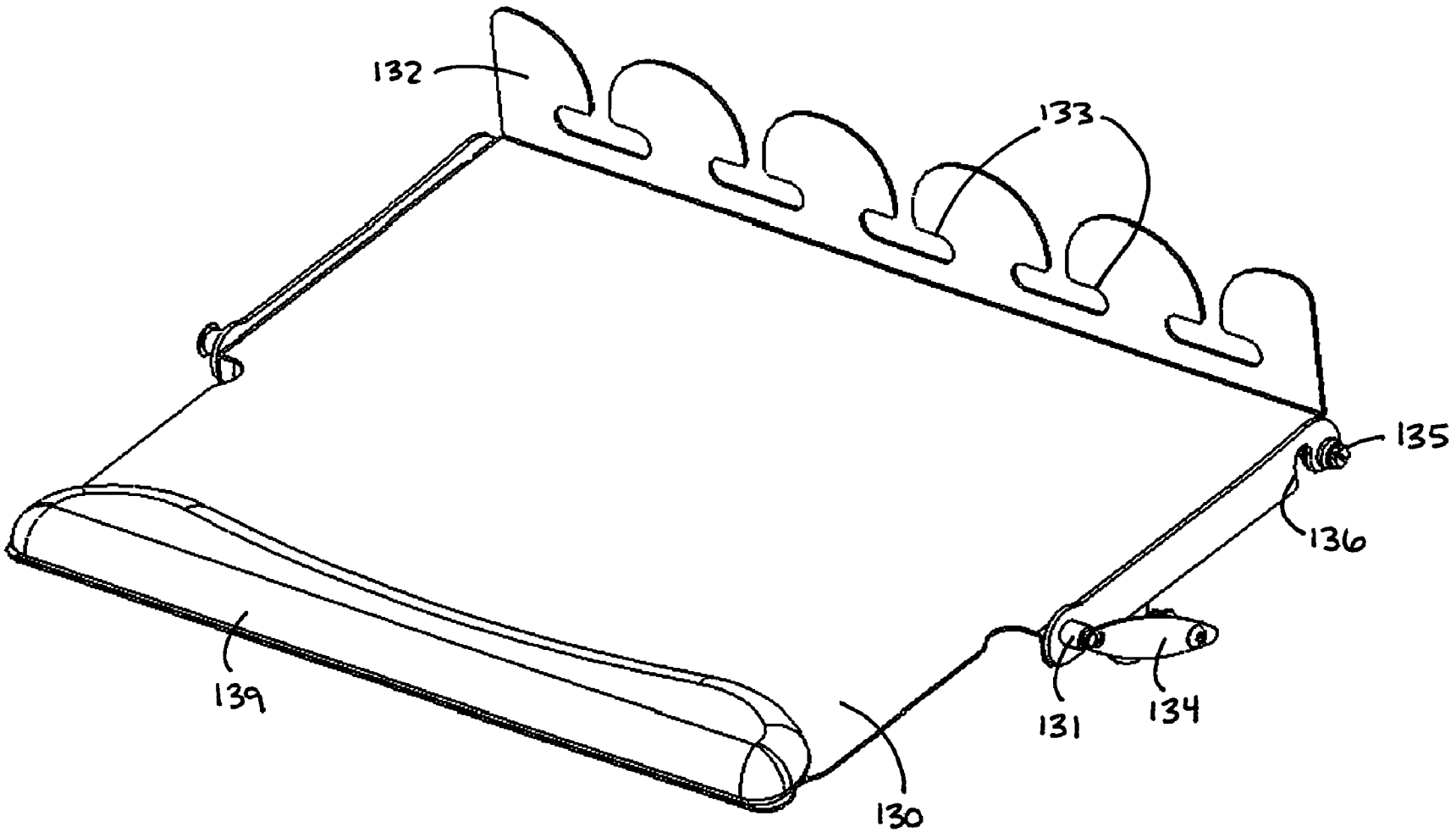
FIG. 8 is a perspective view a support tray for use in the convertible workstation of FIG. 1.
Figure 9:
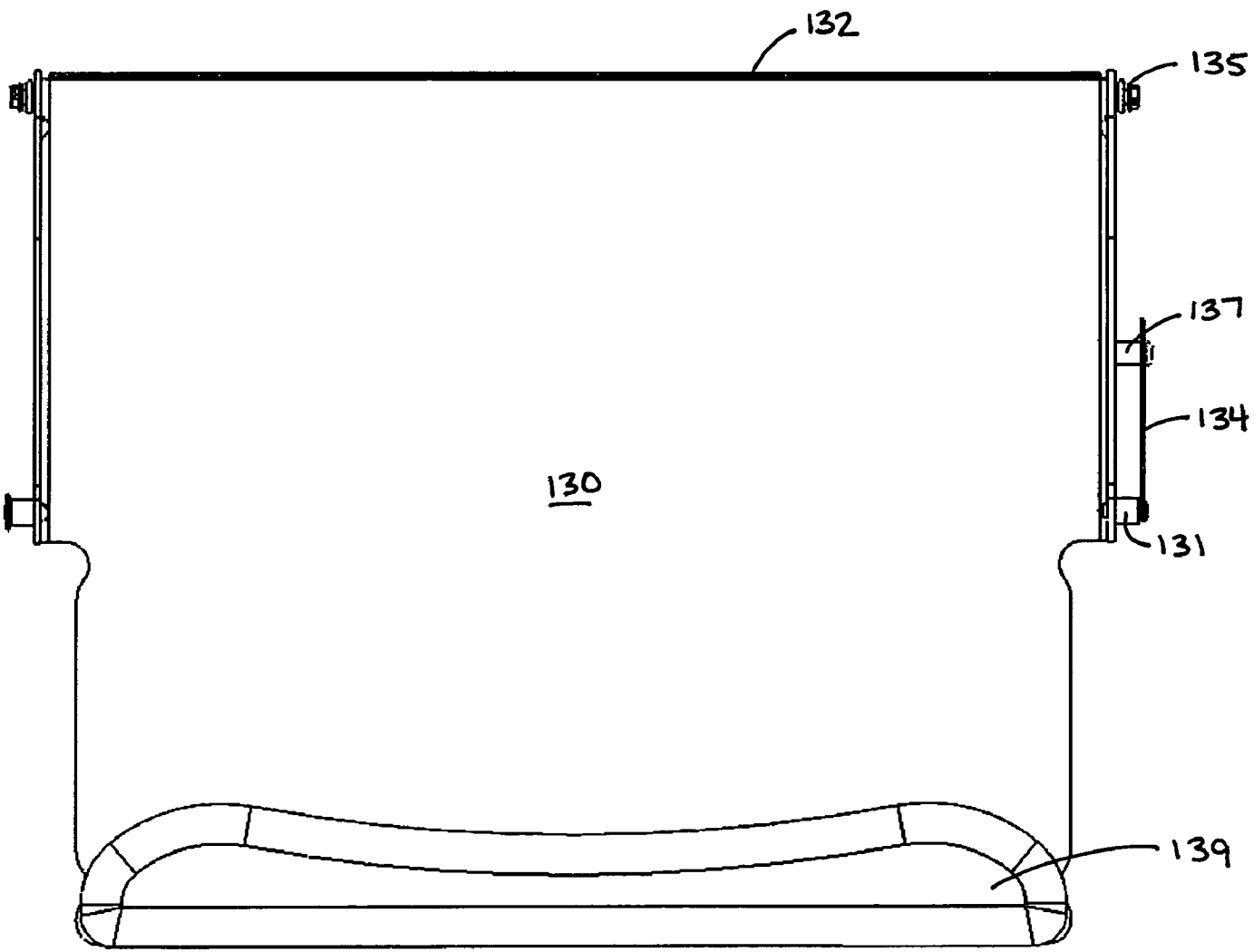
FIG. 9 is a top view of the support tray of FIG. 8.

Next, as shown in FIGS. 3 and 8-9, support tray 130 includes a generally flat base and a slotted back wall 132 having one or more slots 133 extending through such back wall. Slots 133 allow cables to extend through back wall 132, such as power and/or data cables attached to a computer situated on support tray 130, while maintaining a wall structure to prevent unauthorized access to support tray 130 (and to a computer situated thereon) from behind. A first roller 131 is situated on at least one side of support tray 130, and engages roller guide channel 116 on bracket 115 as support panel 120 is moved into and out of its closed position. First roller 131 also engages stop ledge 125 on frame 120 to limit upward pivoting of support panel 110 as support tray is moved from its inaccessible position below work surface 200 to its deployed position. A second roller 137 is also preferably provided as a stop against stop ledge 125 on frame 120, in turn limiting the upward movement of support panel 120 as support tray 130 extends to its deployed position, after first roller 131 has cleared stop ledge 125. Rollers 131 and 137 may be attached to one another through a support finger 134 for additional support.

An underside of support tray 130 may be provide one or more strips of low friction material, such as TEFLON, to limit friction between the underside of support tray 130 and work surface 200 as support tray 130 moves into and out of its inaccessible and deployed positions. Support tray 130 may include a wrist support 139, and may include one or more high friction pads 139a to limit movement of a computer situated on support tray 130.

Support tray 130 also preferably includes notches 136 configured to receive pegs 136a on brackets 115 when support tray 130 is in its open position, providing an additional pivoting connection between support tray 130 and bracket 115.

Figure 10:
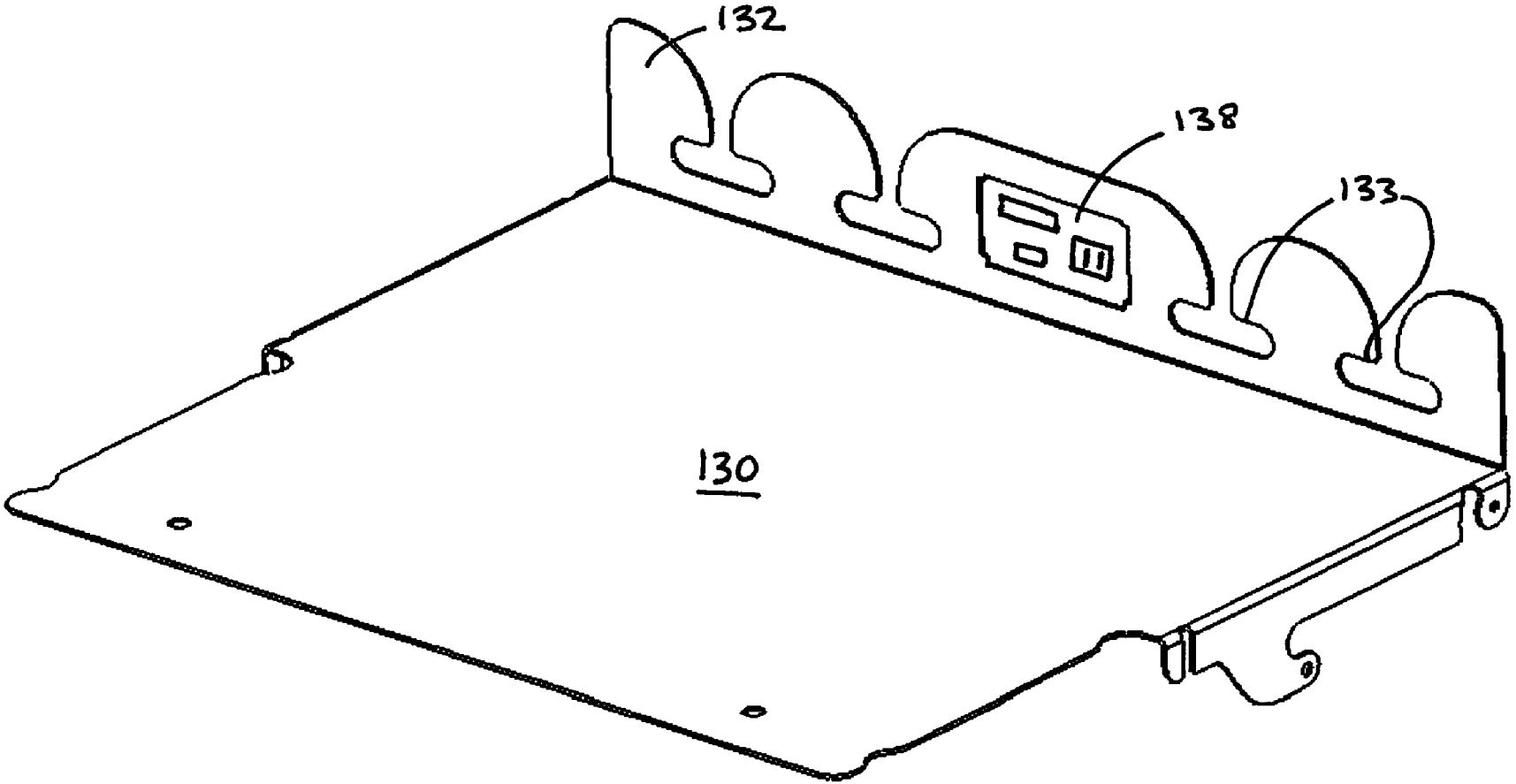
FIG. 10 is a perspective view of a support tray according to an alternate embodiment.

As shown in FIG. 10, support tray 130 may optionally be provided a computer connection panel 138, providing computer connections such as power, data, and connection to peripheral communications devices for a computer situated on support tray 130.

Figure 11:
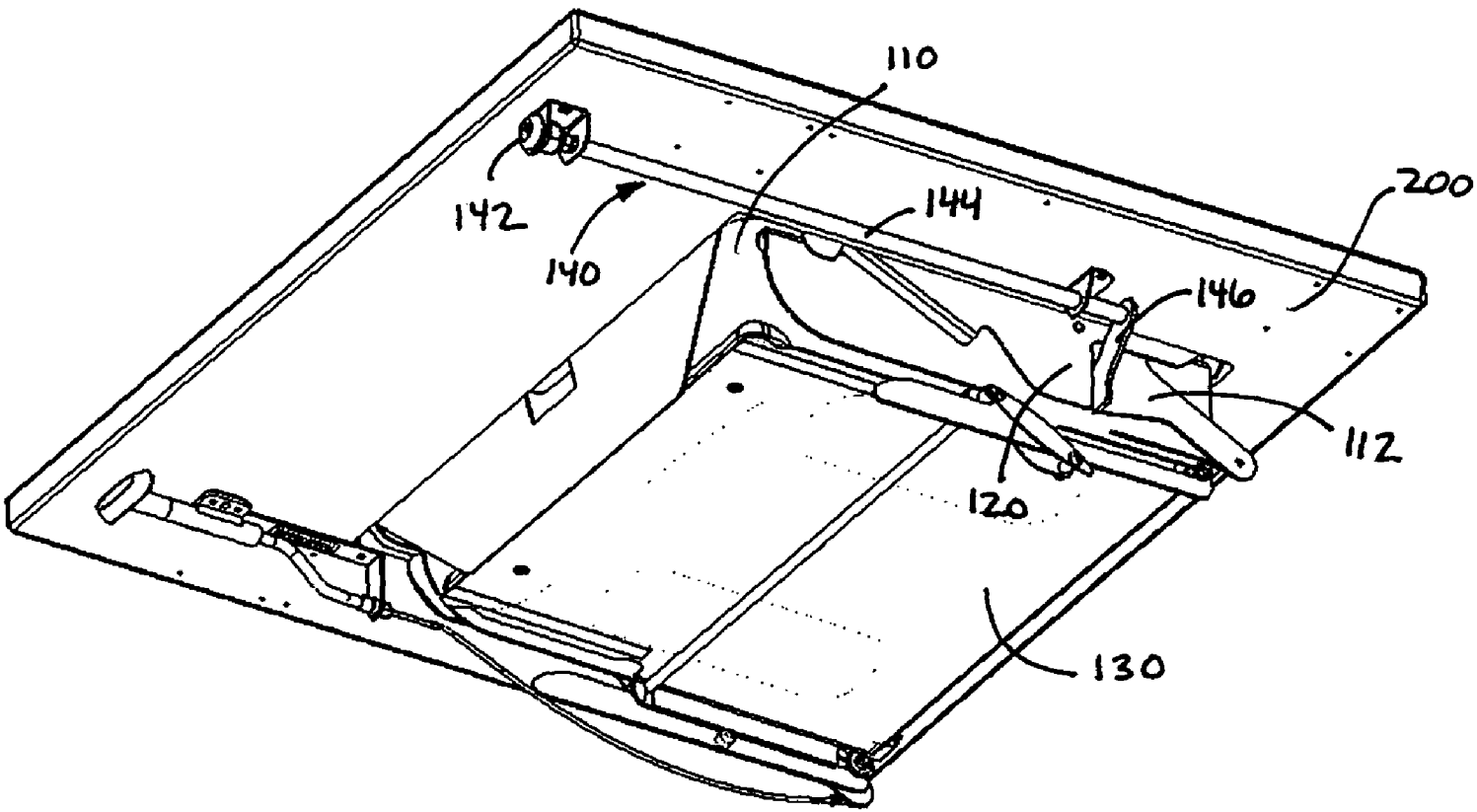
FIG. 11 is a bottom perspective view of the convertible workstation of FIG. 1 in a locked position.
Figure 12:
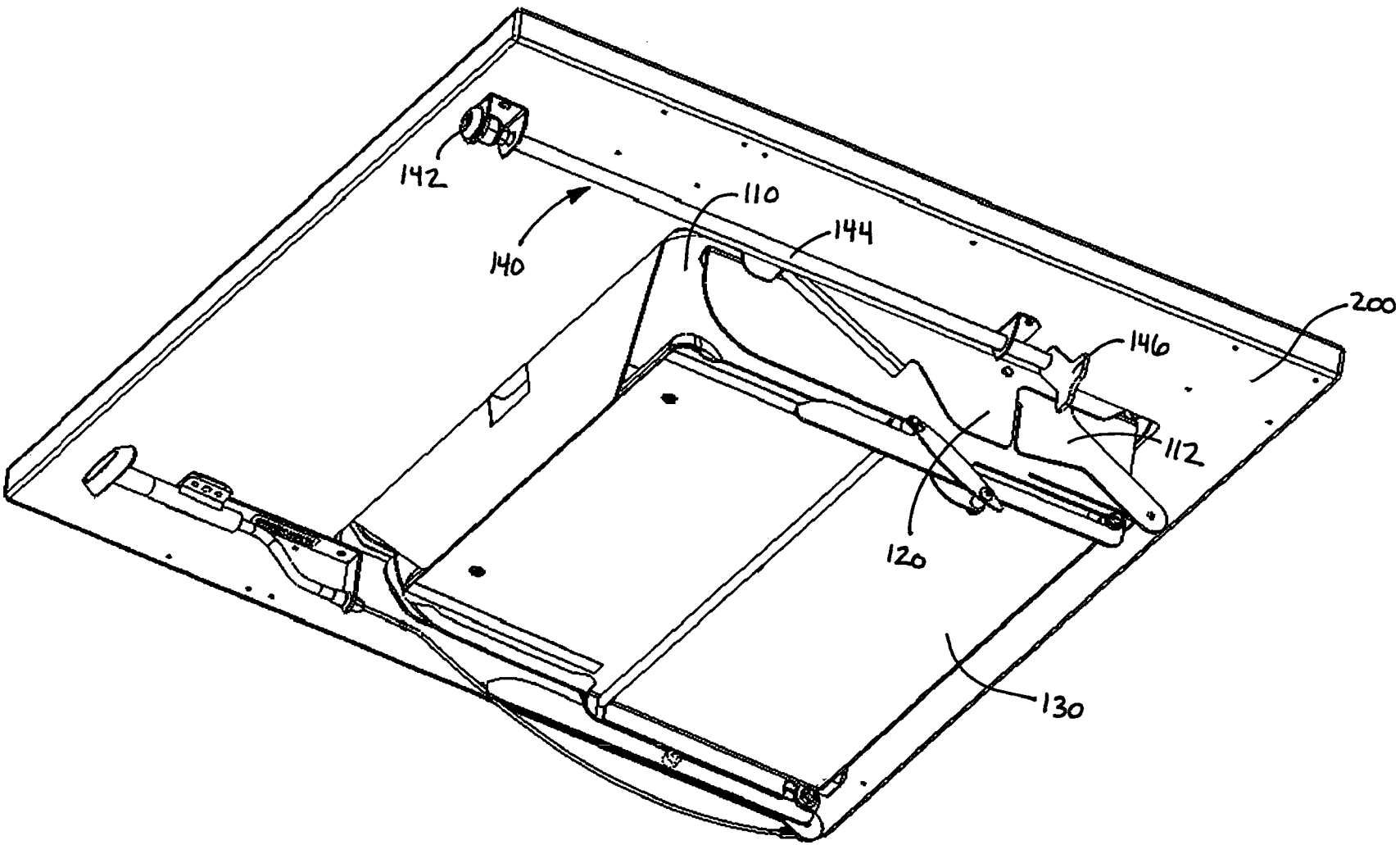
FIG. 12 is a bottom perspective view of the convertible workstation of FIG. 1 in an unlocked position.

As shown in the bottom perspective view of FIGS. 11 and 12, a lock assembly 140 may be provided that engages support panel 110, and particularly one of pivot supports 112, in a locked position (shown in FIG. 11) so as to prevent movement of pivot support 112, and thus of support panel 110, with respect to work surface 200. A key lock 142, which is accessible to a user, may be rotated to rotate extension arm 144 and in turn move a locking plate 146 into and out of engagement with one of pivot supports 112. FIG. 12 shows the locking plate 146 disengaged from pivot support 112, thus allowing support panel 110 to be moved toward its open position.

As best seen in FIG. 3, in order to move support panel 110 from its closed position to its open position, and thus support tray 130 from its inaccessible position to its deployed position, a pull cable 150 is provided (preferably attached to an underside of work surface 200) having a pull handle accessible to a user and a flexible cord 152 pivotably mounted at a first end to an extending arm 113 of one of pivot supports 112 through pin connection 114, and mounted at the opposite end to the pull handle. Thus, pulling the handle results in pulling extending arm 113 outward, causing support panel 110 to begin to pivot towards its open position.

Figure 13:
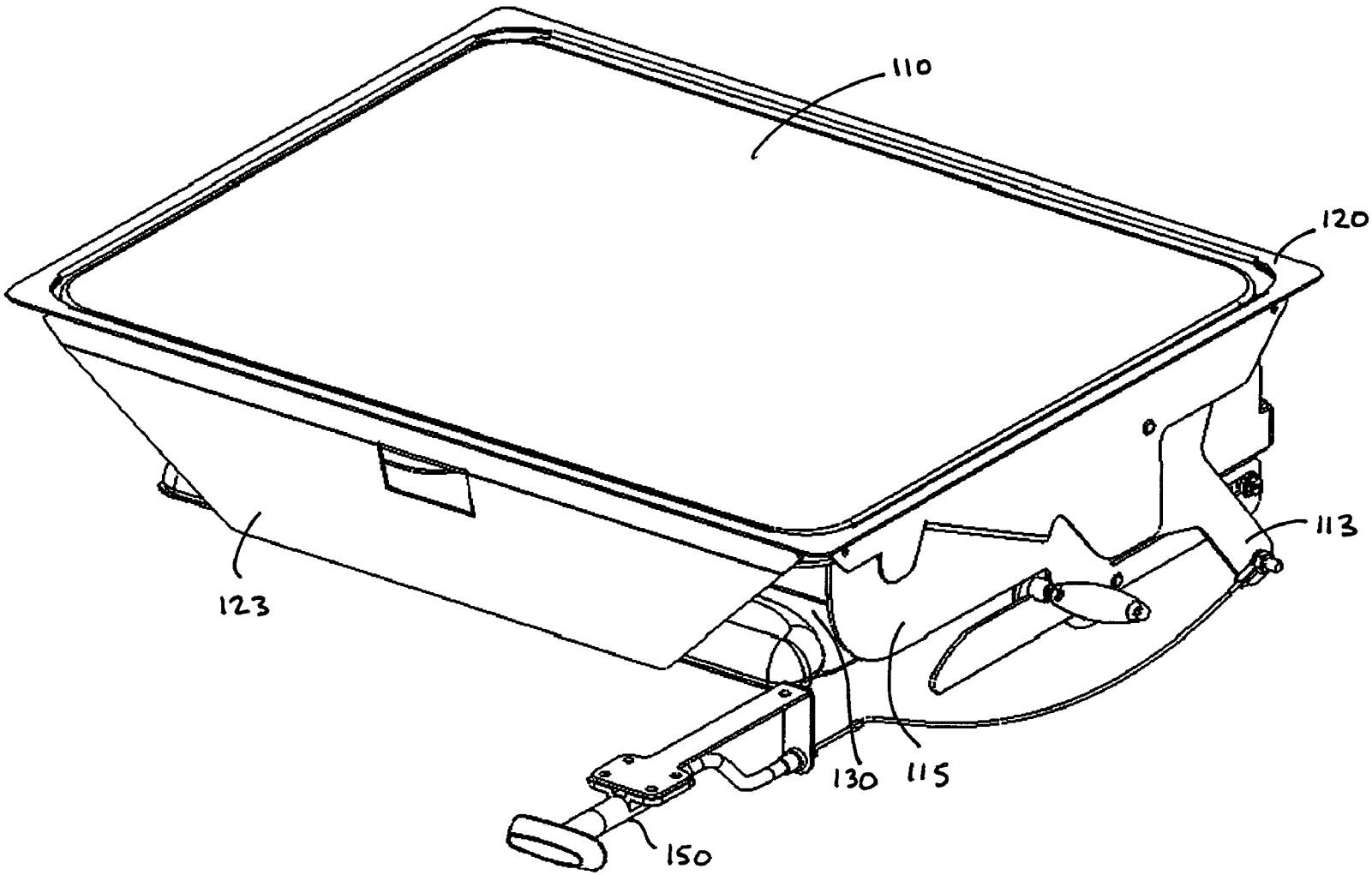
FIG. 13 is a perspective view of the convertible workstation of FIG. 1 in a closed position.
Figure 14:
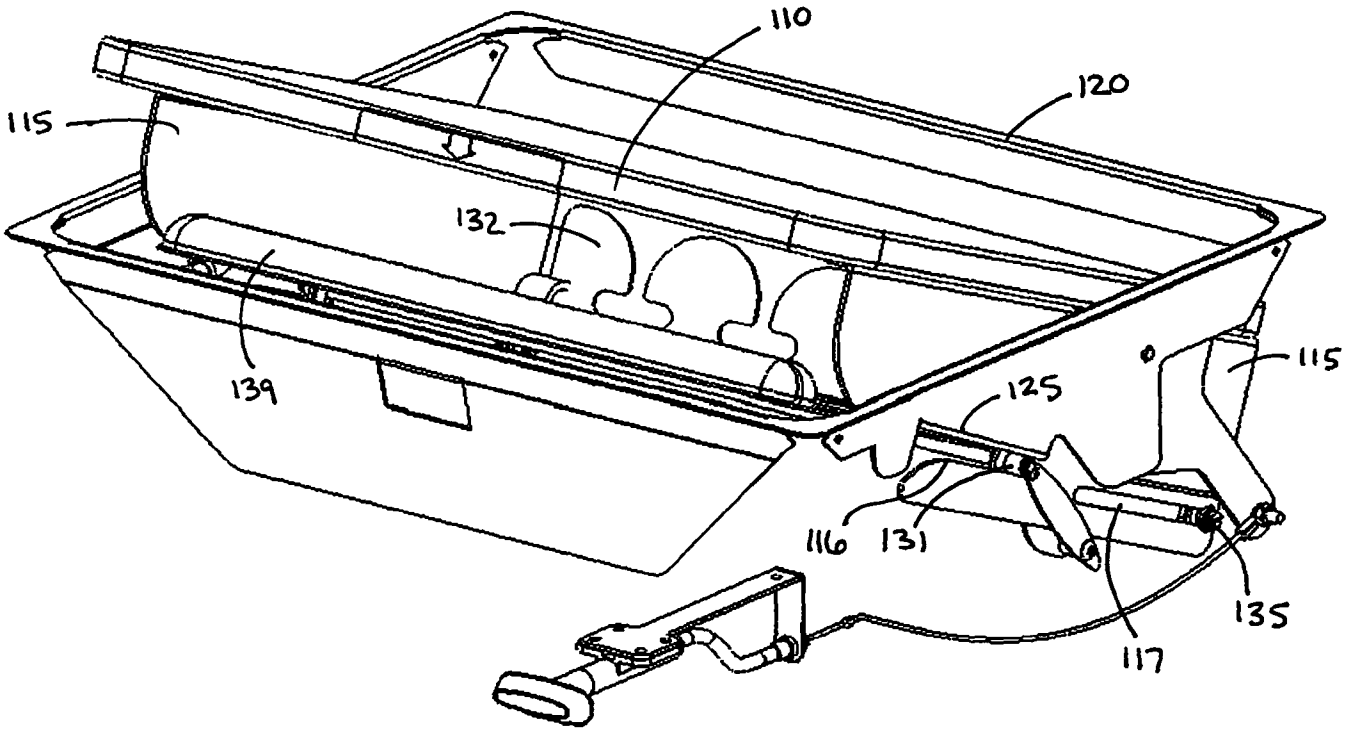
FIG. 14 is a perspective view of the convertible workstation of FIG. 1 in an intermediate position.
Figure 15:
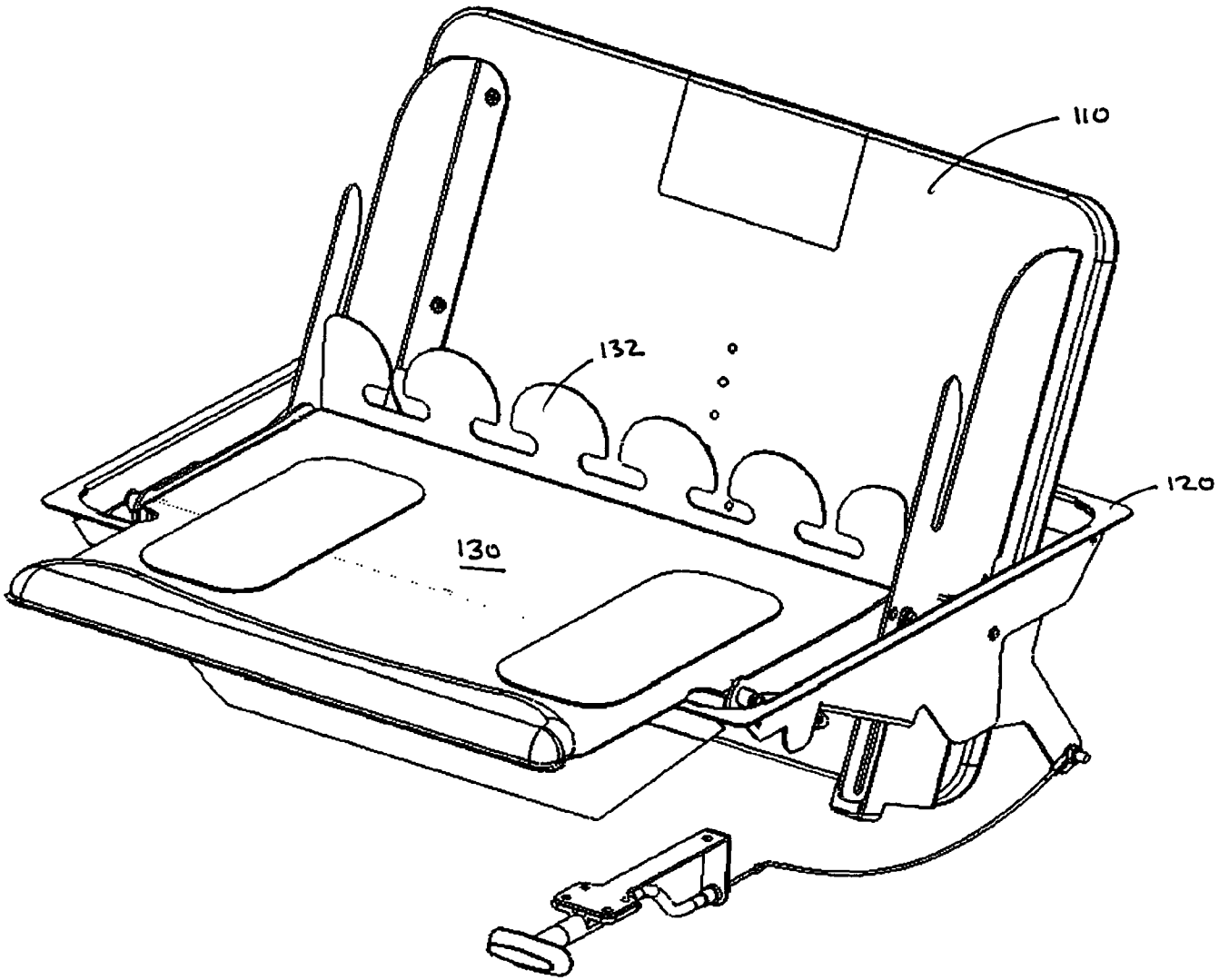
FIG. 15 is a perspective view of the convertible workstation of FIG. 1 in an open position.

FIGS. 13-15 show conversion of the above-described workstation from a work surface to a computer station. First referring to FIG. 13, support panel 110 is shown positioned such that its top side is generally coplanar with a work surface in which the workstation is installed (not shown in FIGS. 13-15 for clarity). In this closed position of support panel 110, support tray 130 is in its stored and inaccessible position. More specifically, access to support tray 130 is prevented by flange 123 of frame 120 from the front, side brackets 115 from the sides, and back wall 132 of support tray 130 from the back. In this position, when pull cable 150 is pulled, arm 113 of one of pivot supports 112 is pulled forward, in turn causing support panel 110 to begin to pivot upward out of the plane of work surface 200. Such upward, opening movement of support panel 110 continues until roller 131 on support tray 130 engages stop ledge 125 on frame 120, at which point the workstation is in the partially open position of FIG. 14. From this position, support tray 130 (and particularly wrist support 139) may be grasped by the user and pulled toward the user to continue movement of support panel 110 toward its open position and of support tray 130 toward its deployed position. During this travel, roller 131 moves forward along roller guide channel 116, and pivot pin 135 moves forward along pivot slide 117. As this movement continues, roller 131 ultimately clears channel 116, at which point continued motion of support tray 130 towards the user causes support tray 130 to pivot with respect to support panel 100, until support tray 130 reaches its fully deployed position. Closure of the workstation may in turn be carried be pushing support tray 130 into the workstation while pivoting support panel 110 downward, continuing the movement of support tray inward until back wall 132 engages cushions 119, and thereafter closing support panel 110 so that it again sits flush with the top of work surface 200.

As the above-described structure allows closure of the workstation with a computer, such as a laptop, positioned on support tray 130 while maintaining power and data connections, a user may close the workstation without powering down the computer, thus making it readily and conveniently accessible when the workstation is reopened.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

The invention claimed is:

1. A convertible workstation comprising:

a support panel having a top side and a bottom side, said support panel being pivotably mounted within a work surface from a closed position in which said top side is generally coplanar with said work surface to an open position; and a support tray pivotably mounted to said bottom side of said support panel;

said bottom side of said support panel further comprising a support tray mount, said support tray mount being adapted to hold said support tray in an inaccessible position when said support panel is in said closed position, and being adapted to pivotably deploy said support tray to a deployed position when said support panel is in said open position; and a pull cable mounted on an underside of said work surface, wherein said pull cable is attached to said support panel such that movement of said pull cable away from said support panel when said support panel is in said closed position causes said support panel to move toward said open position.

2. The convertible workstation of claim 1, said support tray further comprising a connection panel having at least one connection port for electronically connecting a computer positioned on said support tray to peripheral computer equipment.

3. The convertible workstation of claim 1, said support panel further comprising at least one bracket having a roller guide channel, and said support tray further comprising at least one roller mounted on a side of said support tray, said support tray being pivotably mounted to said bracket, and said roller being positioned within said roller guide channel when said support panel is in said closed position and moving within said roller guide channel as said support panel is moved between said closed position and said open position.

4. The convertible workstation of claim 3, said roller being positioned outside of said roller guide channel when said support panel is in said open position.

5. The convertible workstation of claim 1, further comprising a lock engaging said support panel and being moveable from a first locked position, in which said support panel is prevented from pivoting with respect to said work surface, to an unlocked position, in which said support panel is allowed to pivot with respect to said work surface.

6. The convertible workstation of claim 1, further comprising a spring member biasing said support panel toward said open position.

7. The convertible workstation of claim 1, further comprising a frame positioned between at least a portion of said support panel and said work surface, said frame having a flange preventing access to said support tray when said support panel is in said closed position.

8. The convertible workstation of claim 7, said frame further comprising a stop engaging said support tray so as to limit movement of said support panel toward said open position.

9. The convertible workstation of claim 1, further comprising a flange attached to said work surface positioned adjacent to an edge of said support panel when said support panel is in said closed position, said flange preventing access to said support tray when said support panel is in said closed position.

10. A convertible workstation, comprising:

a support panel pivotably mounted within a flat work surface; and a computer support tray pivotably mounted to an underside of said support panel and deployable from a stored position beneath said support panel to a deployed position in which at least a portion of said computer support tray is supported from below by said flat work surface.

11. The workstation of claim 10, said computer support tray further comprising a connection panel having at least one connection port for electronically connecting a computer positioned on said computer support tray to peripheral computer equipment.

12. The workstation of claim 10, said support panel further comprising at least one bracket having a roller guide channel, and said computer support tray further comprising at least one roller mounted on a side of said computer support tray, said computer support tray being pivotably mounted to said bracket, and said roller being movable within said roller guide channel.

13. The workstation of claim 12, said roller being positioned outside of said roller guide channel when said computer support tray is in said deployed position.

14. The workstation of claim 10, further comprising a lock engaging said support panel and being movable from a first locked position, in which said support panel is prevented from pivoting with respect to said work surface, to an unlocked position, in which said support panel is allowed to pivot with respect to said work surface.

15. The workstation of claim 10, further comprising a pull cable mounted on an underside of said work surface, wherein said pull cable is attached to said support panel such that movement of said pull cable away from said support panel when said computer support tray is in said stored position causes said support panel to move said computer support tray toward said deployed position.

16. The workstation of claim 10, further comprising a spring member biasing said support panel toward said deployed position.

17. The workstation of claim 10, further comprising a frame positioned between at least a portion of said support panel and said work surface, said frame having a flange preventing access to said computer support tray when said computer support tray is in said stored position.

18. The workstation of claim 17, said frame further comprising a stop engaging said computer support tray so as to limit movement of said support panel toward said deployed position.

19. The workstation of claim 10, further comprising a flange attached to said work surface positioned adjacent to an edge of said support panel when said computer support tray is in said stored position, said flange preventing access to said computer support tray when said computer support tray is in said stored position.

20. A work surface convertible to a computer workstation, comprising:

a frame configured for insertion into a work table;

a support panel pivotably mounted within said frame; and a computer support tray pivotably mounted to an underside of said support panel and deployable from a stored position beneath said support panel to a deployed position in which at least a portion of said computer support tray extends above and over said frame;

said support panel further comprising at least one bracket having a roller guide channel, and said computer support tray further comprising at least one roller mounted on a side of said computer support tray, said computer support tray being pivotably mounted to said bracket, and said roller being movable within said roller guide channel.

21. The work surface of claim 20, said computer support tray further comprising a connection panel having at least one connection port for electronically connecting a computer positioned on said computer support tray to peripheral computer equipment.

22. The work surface of claim 20, further comprising a spring member biasing said support panel toward said deployed position.

23. The work surface of claim 20, said frame further comprising a flange positioned adjacent to an edge of said support panel when said computer support tray is in said stored position, said flange preventing access to said computer support tray when said computer support tray is in said stored position.

* * * * *